US006703795B2

(12) United States Patent
Johnson

(10) Patent No.: US 6,703,795 B2
(45) Date of Patent: Mar. 9, 2004

(54) AUXILIARY CONTROLLER

(75) Inventor: James C. Johnson, Conyers, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 10/080,506

(22) Filed: Feb. 25, 2002

(65) Prior Publication Data

US 2003/0160573 A1 Aug. 28, 2003

(51) Int. Cl.[7] ..... H05B 41/16; G05F 1/00
(52) U.S. Cl. ..... 315/273; 315/291
(58) Field of Search ..... 315/149–156, 315/254, 256, 266, 274, 273, 279, 307, 244, 291

(56) References Cited

U.S. PATENT DOCUMENTS 3,694,692 A * 9/1972 Pressman ..... 315/154
3,890,534 A * 6/1975 Horowitz ..... 315/92
3,894,265 A * 7/1975 Holmes et al. ..... 315/194
4,005,331 A 1/1977 Horowitz
4,134,043 A * 1/1979 Nuver ..... 315/92
4,506,195 A * 3/1985 Elms ..... 315/205
4,513,227 A * 4/1985 Labadini et al. ..... 315/290
4,985,661 A * 1/1991 Lin ..... 315/87
6,072,286 A * 6/2000 Sears ..... 315/313
6,124,684 A * 9/2000 Sievers ..... 315/307
6,489,729 B1 * 12/2002 Erhardt et al. ..... 315/209 R

OTHER PUBLICATIONS

"Understanding HPS Ballasts," Cooper Industries, pp. 130–133.

* cited by examiner

*Primary Examiner*—James Clinger
(74) *Attorney, Agent, or Firm*—Thomas, Kayden, Horstemeyer & Risley, L.L.P.

(57) ABSTRACT

A lighting system includes a primary lamp circuit, an auxiliary lamp circuit, and an auxiliary controller. The auxiliary controller is connected between the primary lamp circuit and the auxiliary lamp circuit and is operable to sense a primary lamp circuit voltage. The auxiliary controller extinguishes an auxiliary lamp when the primary lamp circuit voltage exceeds a threshold voltage.

23 Claims, 6 Drawing Sheets

100
108
Auxiliary Controller
106
Lighting System
110
112
104
+
+

106
Ballast Capacitor
120
HID Lamp
114
117
Ballast Secondary
118
Ballast Primary
116

300
310
8
Q
RES
A
B
AR
MO
Q/Q\
RTC
CTC
RS
6
12
13
5
10
9
1
2
3
304
308
312
306

AUXILIARY CONTROLLER

TECHNICAL FIELD

This invention relates to an auxiliary lighting controller for a lighting system.

BACKGROUND

An auxiliary lighting system may illuminate an auxiliary lamp to supplement a high intensity discharge (HID) lamp from the time that the HID lamp is activated until the HID lamp achieves full illumination, which may require several minutes. Whenever the HID lamp is deenergized by, for example, a momentary power failure, the HID lamp requires several minutes to cool off before it can be turned back on to provide illumination.

A circuit to control an auxiliary lamp may use a current transformer to sense the HID lamp current in order to determine whether the HID lamp is "on." The current transformer actuates a mechanical relay to provide power to the auxiliary lamp as appropriate.

SUMMARY

In one general aspect, a lighting system includes a primary lamp circuit, an auxiliary lamp circuit, and an auxiliary controller. The auxiliary controller is connected between the primary lamp circuit and the auxiliary lamp circuit and is operable to sense a voltage of the primary lamp circuit. The auxiliary lamp circuit includes an auxiliary lamp. The auxiliary controller operates to extinguish the auxiliary lamp when the voltage of the primary lamp circuit exceeds a threshold voltage.

Implementations may include one or more of the following features. For example, the primary lamp circuit may include an impedance element in series connection with a discharge lamp. The impedance element may be a ballast capacitor or a ballast reactor.

The primary lamp circuit also may include a high intensity discharge lamp, such as a gas vapor lamp. The auxiliary lamp may be an incandescent lamp.

The auxiliary controller may have output leads that are connected to the auxiliary lamp. The auxiliary controller also may have input leads that are connected across the impedance element.

In another general aspect, an auxiliary controller for a lighting system includes a power supply circuit, a switching circuit, and a coupling circuit that connects the power supply circuit to the switching circuit. The power supply circuit has input and output voltages and the switching circuit has open and closed states. An increase in the input voltage beyond a certain threshold causes an increase in the output voltage that biases the switching circuit in the open state.

The power supply circuit may have input terminals for connection to an alternating current voltage. An impedance capacitor may be connected in series with one of the input terminals to provide impedance to the alternating current voltage. A diode bridge may be connected to the impedance capacitor and to the input terminals. The diode bridge may produce unfiltered direct current voltage from the alternating current voltage.

A filter capacitor may be connected across the diode bridge to remove ripple voltages and produces a steady direct current voltage. A zener diode may be connected across the filter capacitor to clamp the direct current voltage to a predetermined level. Output terminals may be connected across the zener diode, and a current limiting resistor may be connected in series with the output terminals.

The coupling circuit of the auxiliary controller may have an optically isolated triac that has open and closed states. Increasing the power supply circuit input voltage above a threshold voltage may increase the power supply output voltage to bias the optically isolated triac in the closed state.

The switching circuit of the auxiliary controller may have a voltage divider that is connected to the coupling circuit. A triac may be connected to the voltage divider by a diac. The triac may be triggered into conduction when a breakover voltage on the diac is exceeded.

In another general aspect, operating a lighting system includes providing a primary lamp circuit, providing an auxiliary lamp circuit, connecting an auxiliary controller between the primary lamp circuit and the auxiliary lamp circuit, sensing a primary lamp circuit voltage, and extinguishing an auxiliary lamp when the primary lamp circuit voltage exceeds a threshold voltage. The primary lamp circuit, the auxiliary lamp circuit, and the auxiliary controller may have some or all of the features described above.

The current implementation eliminates the need for a current transformer from the auxiliary lighting system, which can reduce costs, weight, and bulk, and can improve performance.

The details of one or more implementations are set forth in the drawings and the description. Other features and advantages will be apparent from the description, including the drawings and the claims.

DESCRIPTION OF DRAWINGS

Like reference symbols in the various drawings indicate like elements.

DETAILED DESCRIPTION

Figure 1:
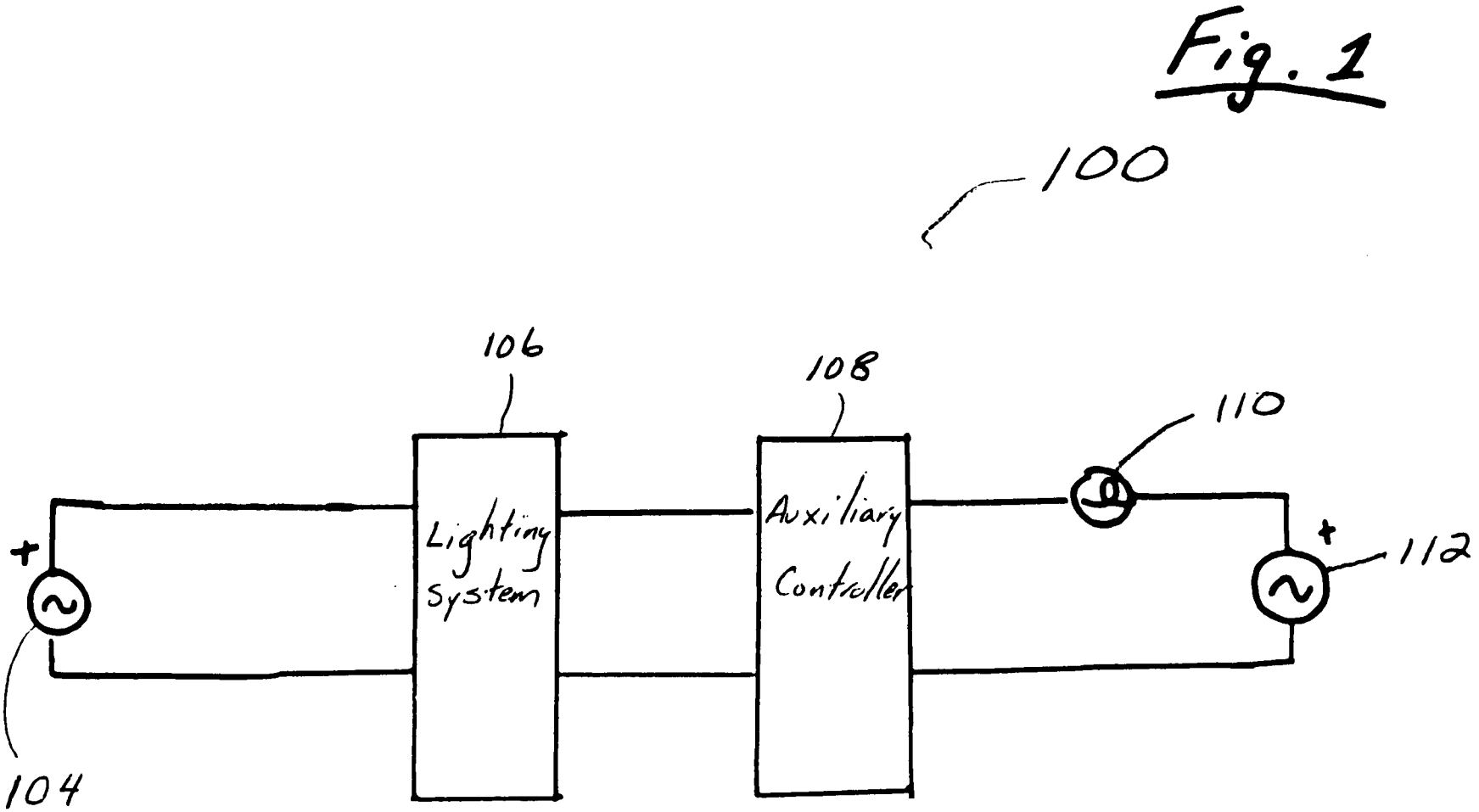
FIG. 1 is a block schematic diagram of a lighting system.

Referring to FIG. 1, a lighting system 100 includes a power supply 104, a primary lighting system 106, an auxiliary controller 108, an auxiliary lamp 110, and an auxiliary power supply 112. The power supplies typically are 120-volt alternating current (a.c.) sources.

The power supply 104 is connected to the primary lighting system 106 and energizes the primary lighting system 106. The auxiliary controller 108 is connected by input leads 122 to the primary lighting system 106 to monitor the condition of the primary lighting system 106. In the event that auxiliary lighting is desired, the auxiliary controller 108 provides a conductive path through output leads 124 to allow the auxiliary power supply 112 to energize the auxiliary lamp 110.

Figure 2:
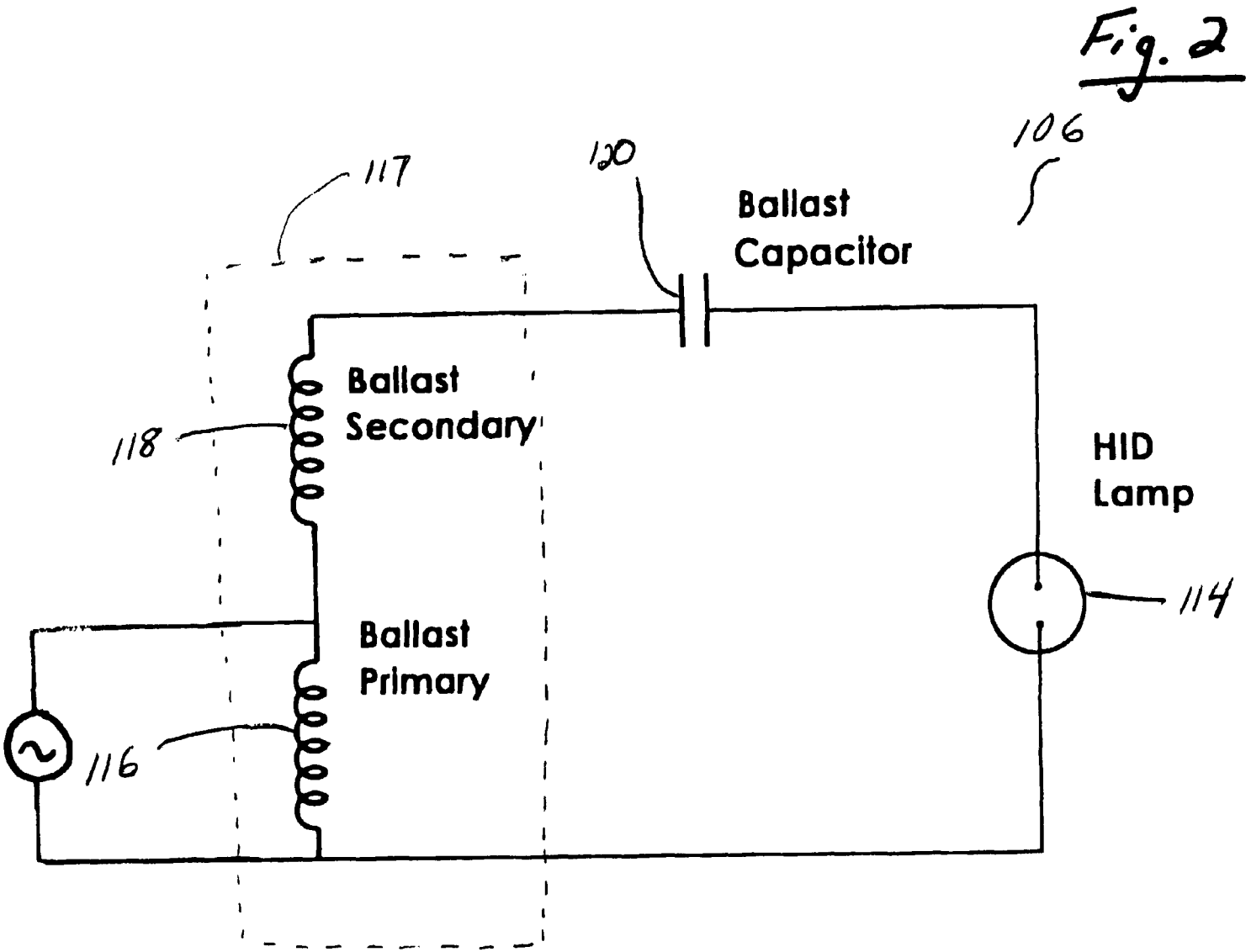
FIGS. 2–4 are schematic diagrams of the lighting system of FIG. 1.

Referring to FIG. 2, the primary lighting system 106 includes an HID lamp 114. The primary lighting system 106 also includes a ballast component. In the implementation shown in FIG. 2, the power supply 104 is connected to a ballast primary 116 of a ballast transformer 117, and the ballast secondary 118 of the ballast transformer 117 is connected to a ballast capacitor 120 that is in series with the HID lamp 114. The ballast transformer 117 transforms the voltage provided by the power supply 104 to permit use on a system with a different voltage from what is required to properly operate the HID lamp 114.

The HID lamp 114 has an inner gas-filled tube through which an arc path strikes or starts the lamp. Once the arc has been established, the HID lamp 114 can have a "negative" resistance since the voltage drops as the current increases. The ballast 117 in conjunction with the capacitor 120 controls and limits the current flow to prevent a runaway current condition.

As shown in FIG. 2, the ballast transformer 117 is an autotransformer having a common winding. In other implementations, the ballast transformer 117 may be eliminated, may have isolated primary and secondary windings, or may have three windings. In a further implementation, the ballast capacitor 120 may be replaced by another component, such as, for example, a choke coil. A starter circuit (not shown) also may be employed to provide a high-voltage, low-power pulse to strike the arc and start the HID lamp 114.

Figure 3:
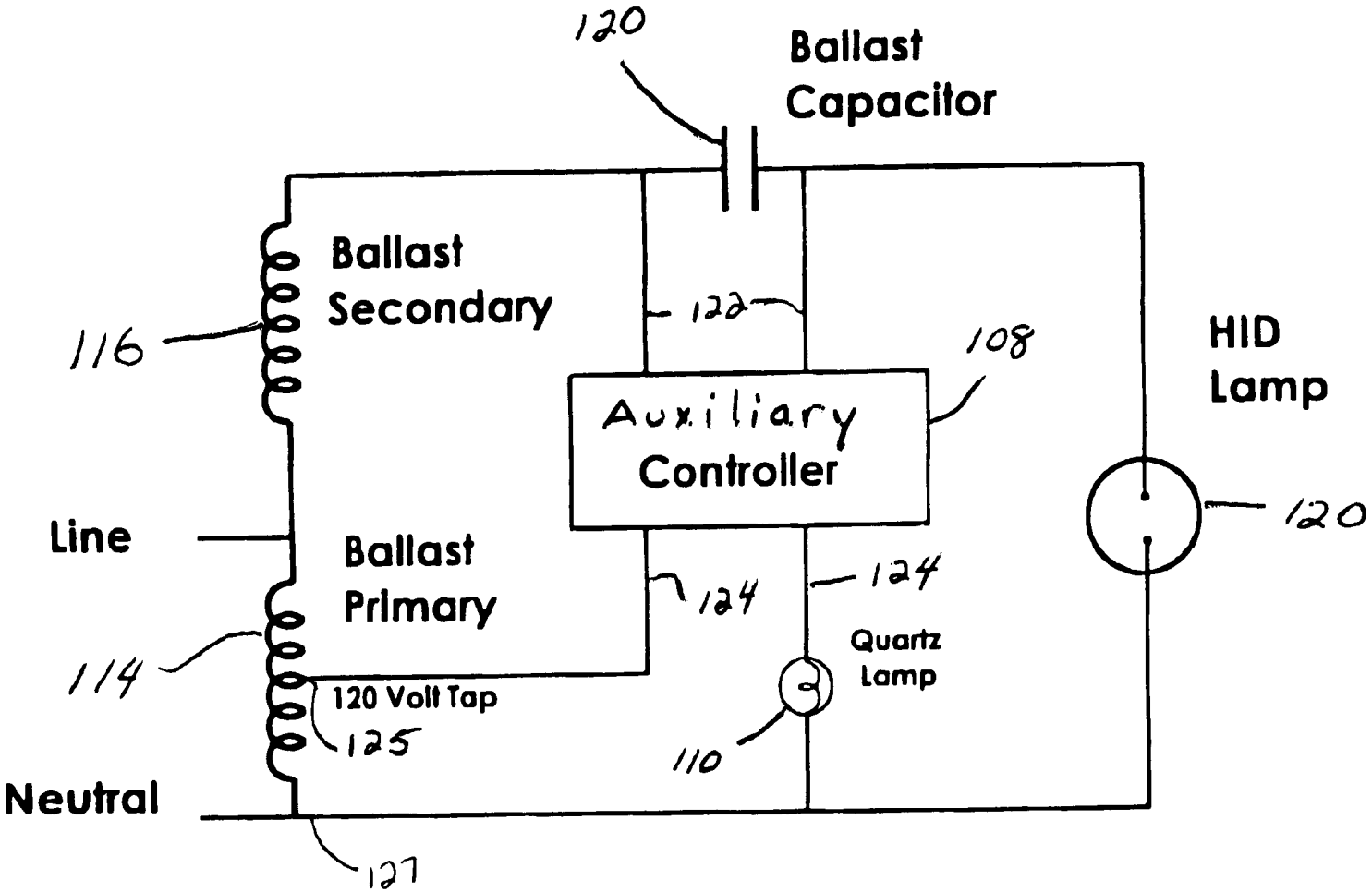

Referring to FIG. 3, the input leads 122 of the auxiliary controller 108 are connected across the ballast capacitor. One output lead 124 is connected to a tap 125 on the ballast primary 114. The other output lead is connected to the auxiliary lamp 110, which is connected to the power supply neutral 127 to provide the auxiliary power source 112. In the implementation shown in FIG. 3, the auxiliary lamp 110 is a quartz lamp. In other implementations, the auxiliary lamp 110 may be another type of lamp having instant-on characteristics, such as, for example, an incandescent lamp.

Figure 4:
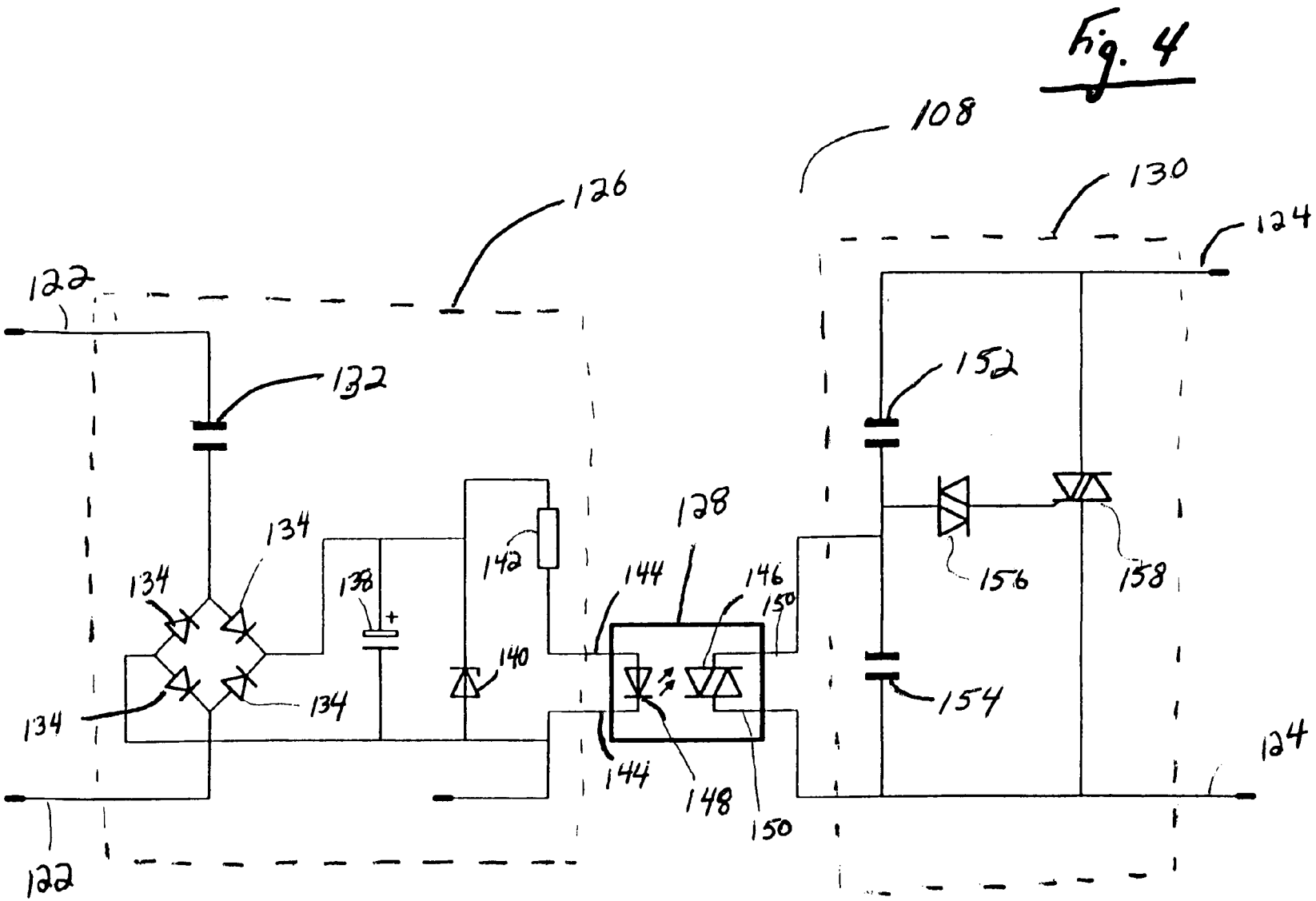

Referring to FIG. 4, the auxiliary controller 108 may be implemented as a solid-state circuit with three sub-circuits that include a power supply circuit 126 that is connected by a coupling circuit 128 to a switching circuit 130. The power supply circuit 126 includes a capacitor 132, diodes 134, a filter capacitor 138, a zener diode 140, and a current limiting resistor 142. The power supply circuit 126 uses the input leads 122 as an ac voltage source. The diodes 134 are configured in a bridge in order to convert the ac voltage to a fluctuating (unfiltered) direct current (d.c.) voltage. The filter capacitor 138 removes ripple voltages 138 for a steady d.c. voltage, and the zener diode 140 clamps the d.c. voltage to a predetermined output level.

The d.c. voltage from the power supply circuit 126 is applied to terminals of the coupler circuit 128. The coupler circuit 128 is an opto-electronic triac 146 that provides isolation between the power supply circuit 126 and the switching circuit 130. As shown in FIG. 4, a light emitting diode 148 drives the triac 146 between open and closed states. Application of d.c. voltage that exceeds a threshold level causes the triac 146 to go from open to closed states. Thus, the triac terminals 150 act as a closed switch in the switching circuit 130 as the voltage on the diode 148 exceeds the threshold voltage.

The switching circuit 130 includes capacitors 152, 154, a diac 156, and a triac 158. The capacitors 152, 154 act as a voltage divider that controls the voltage on the diac 156. In turn, the diac 156 drives the triac 158 between open and closed states depending on the voltage level on the diac. Closing the opto-coupled triac 146 in the coupling circuit 128 causes the input voltage of the diac 156 to drop to ground or reference voltage, which causes the triac 158 to open. The output leads 124 across the triac 158 are connected in series with the auxiliary power source 112 and the auxiliary lamp 110. Thus, the open and closed switching action of the triac 158 extinguishes or illuminates the auxiliary lamp 110.

Figure 5:
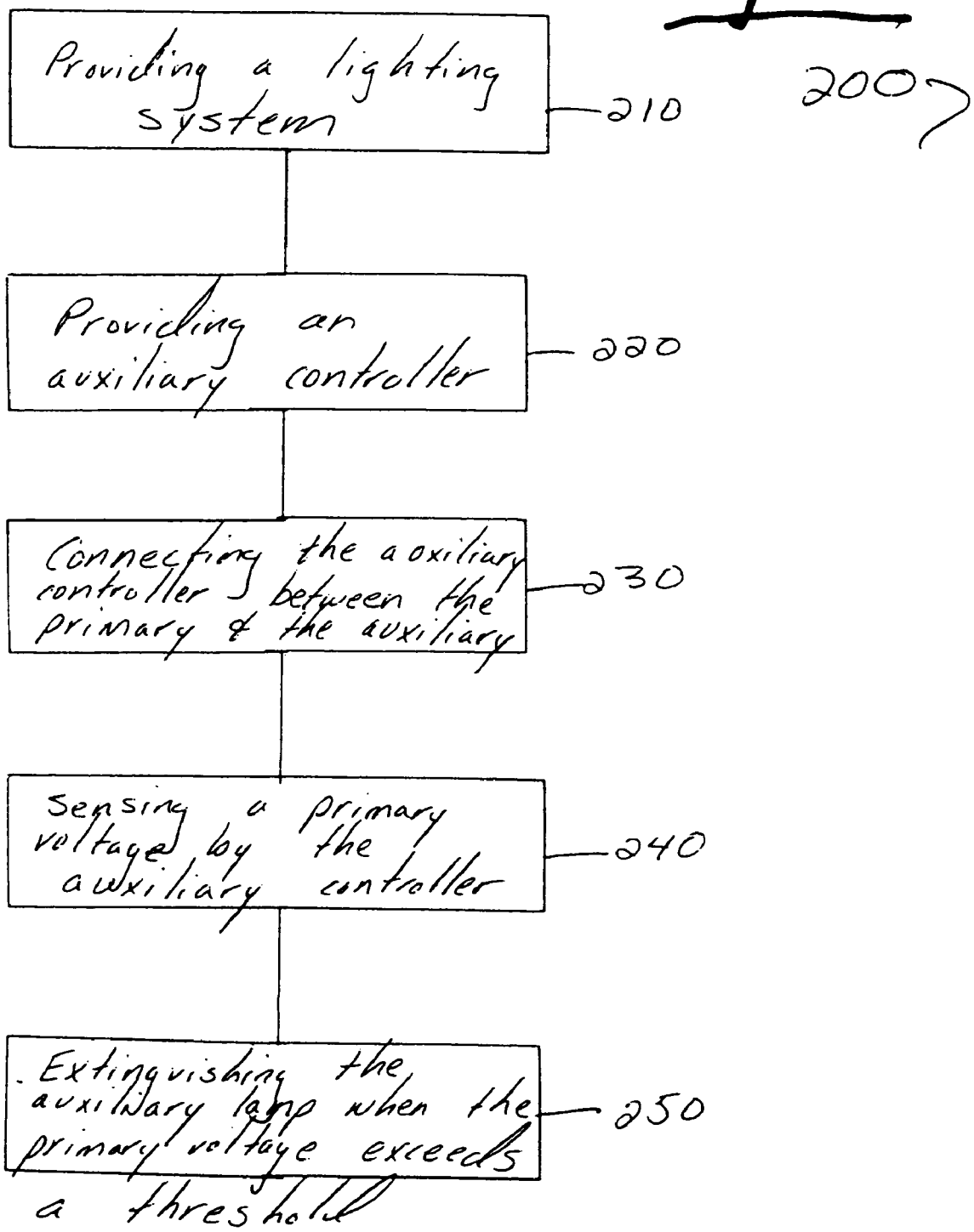
FIG. 5 is a flow chart of a procedure for operating the auxiliary lamp using the lighting system of FIG. 1.

Referring to FIG. 5, a procedure for operating a lighting system includes providing a lighting system having primary and auxiliary lamp circuits (step 210), providing an auxiliary controller (step 220), connecting the auxiliary controller between the primary and the auxiliary lamp circuits (step 230), sensing a voltage on a primary lamp circuit component with the auxiliary controller (step 240), and extinguishing an auxiliary lamp when the component voltage exceeds a threshold voltage (step 250). Examples of the primary lamp circuit, the auxiliary lamp circuit, and the auxiliary controller include those discussed above with respect to FIGS. 1–4. Connecting the auxiliary controller (step 230) includes connecting the auxiliary controller 108 across a component in series with the HID lamp 114, such as, for example, the ballast capacitor 120 as shown above with respect to FIG. 3. In other implementations, the auxiliary controller is connected across a choke coil that is in a series connection with the HID lamp 114.

Sensing a voltage across the lamp circuit (step 240) may include sensing a voltage across the ballast capacitor 120. Since the capacitor 120 is in series with the HID lamp 114, no voltage will appear across the capacitor unless the lamp 114 is in conduction. Thus, sensing the voltage across the capacitor (240) provides an indication of the HID lamp operation. Extinguishing the auxiliary lamp (step 250) occurs as the voltage across the capacitor exceeds the threshold, indicating that the HID lamp 114 is illuminated.

Figure 6:
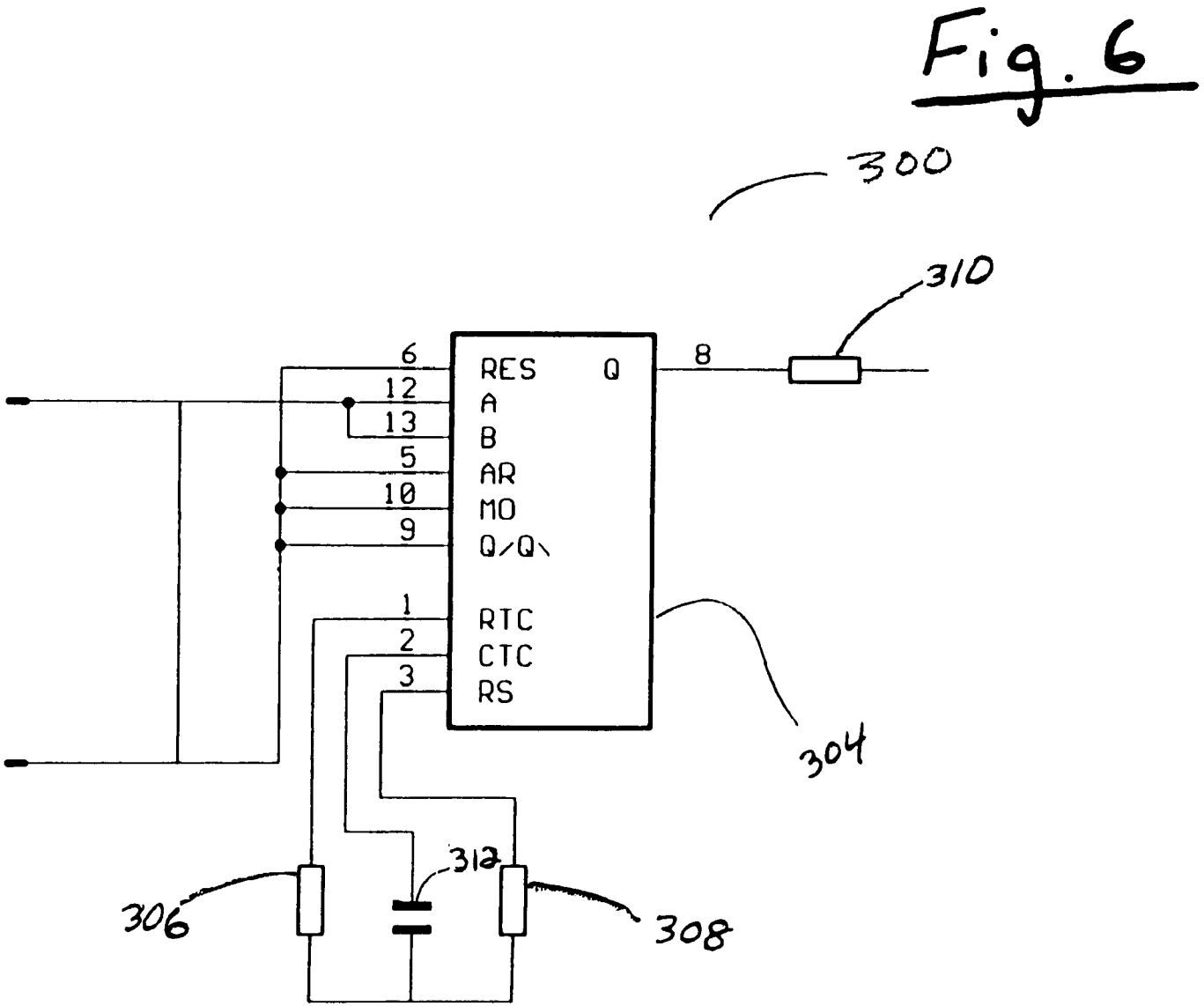
FIG. 6 is a schematic diagram of a timer circuit for the lighting system of FIG. 1.

Referring to FIG. 6, a timer circuit 300 can be added to the lighting system with auxiliary controller 100. The timer circuit includes a timer microchip 304, resistors 306, 308, 310, and a capacitor 312. The timer circuit 300 includes an automatic power-on reset. The timer circuit 300 can be installed between the power supply circuit 126 and the coupling circuit. When the HID lamp 114 first begins to conduct, the timer will initialize and begin to time. At the end of a pre-selected time period, power is applied to the coupling circuit 128, which turns off the auxiliary lamp 110. The timer chip 304 may be an MC14541B programmable timer manufactured by On Semiconductor or the chip 304 may be another type of timer, such as, for example, a 4541-timer chip made by other semiconductor industry manufacturers.

A number of implementations have been described. Nevertheless, it will be understood that various modifications may be made. For example, the auxiliary controller could be configured to control any a.c. load or device that could operate other types of auxiliary equipment. Accordingly, other implementations are within the scope of the following claims.

What is claimed is:

1. An auxiliary controller for a lighting system, comprising:

a power supply circuit having an input voltage and an output voltage and comprising:

a first input terminal and a second input terminal adapted to be connected to an alternating voltage;

an impedance capacitor connected in series with the first input terminal to provide impedance to the alternating voltage;

a diode bridge connected to the impedance capacitor and the second input terminal and configured to produce unfiltered direct current voltage from the alternating voltage;

a filter capacitor connected in parallel with the diode bridge and configured to remove ripple voltages from the unfiltered direct current voltage to produce a steady direct current voltage;

a zener diode connected in parallel with the filter capacitor and configured to clamp the direct current voltage to a predetermined level;

a first output terminal and a second output terminal connected in parallel with the zener diode; and a current limiting resistor connected in series with the first output terminal;

a switching circuit having open and closed states; and a coupling circuit that connects the output voltage of the power supply circuit to the switching circuit;

wherein an increase in the input voltage that exceeds a threshold voltage increases The output voltage to bias the switching circuit in the open state.

2. The auxiliary controller of claim 1 wherein:

the coupling circuit includes an optically isolated triac having on and off states, and increasing the input voltage of the power supply circuit above the threshold voltage increased the output voltage to bias the optically isolated triac in the on state.

3. The auxiliary controller of claim 1 wherein the switching circuit includes:

a voltage divider connected to the coupling circuit;

a triac; and a disc connected between the voltage divider and the triac; wherein the triac is triggered into conduction when a breakover voltage on the disc is exceeded.

4. A circuit for coupling a high intensity discharge (HID) lamp to an auxiliary lamp, comprising:

a light source;

a power supply circuit for energizing the light source when the HID lamp is starting; and a switching circuit, optically coupled to the light source, for energizing the auxiliary lamp when the light source is energized during starting of the HID lamp.

5. The circuit recited in claim 4 wherein the switching circuit also de-energizes the auxiliary lamp when the HID lamp is illuminated.

6. The circuit recited in claim 5, wherein the light source includes a light-emitting diode (LED).

7. The circuit recited in claim 6 wherein the power supply circuit includes a rectifier circuit, arranged in parallel with a ballast capacitor, for providing current to the diode.

8. The circuit recited in claim 7 wherein the rectifier circuit includes:

a full-wave bridge rectifier;

a zener diode for clamping an output of the rectifier; and a filter capacitor for filtering ripple from the output of the full-wave bridge rectifier.

9. The circuit recited in claim 6 wherein the switching circuit includes a triac for activating when the LED is energized.

10. The circuit recited in claim 9 wherein the switching circuit further includes:

a diac for receiving a signal from the activated triac; and another triac, coupled to the diac, for controlling current to the auxiliary lamp.

11. The circuit recited in claim 10 wherein the power supply circuit includes a rectifier circuit, arranged in parallel with a ballast capacitor, for providing current to the LED.

12. The circuit recited in claim 11 wherein the rectifier circuit includes:

a full-wave bridge rectifier;

a zener diode for clamping an output of the rectifier; and a filter capacitor for filtering ripple from the output of the full-wave bridge rectifier.

13. A circuit for coupling a high intensity discharge (HID) lamp to an auxiliary lamp, comprising:

a light source;

power supply means for energizing the light source when the HID lamp is starting; and switching means, optically coupled to the light source, for energizing the auxiliary lamp when the light source is energized during starting of the HID lamp.

14. The circuit recited in claim 13 wherein the switching means also de-energizes the auxiliary lamp when the HID lamp is illuminated.

15. The circuit recited in claim 14, wherein the light source includes a light-emitting diode (LED).

16. The circuit recited in claim 15 wherein the power supply means includes rectifier means, arranged in parallel with a ballast capacitor, for providing current to the LED.

17. The circuit recited in claim 16 wherein the rectifier means includes a full-wave bridge rectifier;

a zener diode for clamping an output of the bridge rectifier; and a filter capacitor for filtering ripple from the output of the full-wave bridge rectifier.

18. The circuit recited in claim 15 wherein the switching means includes a triac for activating when the LED is energized.

19. The circuit recited in claim 18 wherein the switching means further includes:

a diac for receiving a signal from the activated triac; and another triac, arranged in series with the diac, for controlling current to the auxiliary lamp.

20. A method of optically coupling a high intensity discharge (HID) lamp to an auxiliary lamp, comprising the steps of:

energizing a light source when the HID lamp is starting; and energizing the auxiliary lamp when the light source is energized during starting of the HID lamp.

21. The method recited in claim 20 further comprising the step of de-energizing the auxiliary lamp when the HID lamp is illuminated.

22. A method of optically coupling a high intensity discharge (HID) lamp to an auxiliary lamp, comprising:

a step for energizing a light source when the HID lamp is starting; and a step for energizing the auxiliary lamp when the light source is energized during starting of the HID lamp.

23. The method recited in claim 22 further comprising a step for de-energizing the auxiliary lamp when the HID lamp is illuminated.

* * * * *